United States Patent [19]

Künzel

[11] Patent Number: 4,615,379

[45] Date of Patent: Oct. 7, 1986

[54] STORAGE BODY FOR A REGENERATOR

[75] Inventor: Jürgen Künzel, Thierhaupten, Fed. Rep. of Germany

[73] Assignee: Sigri GmbH, Meitingen bei Augsburg, Fed. Rep. of Germany

[21] Appl. No.: 741,370

[22] Filed: Jun. 5, 1985

[30] Foreign Application Priority Data

Jun. 5, 1984 [DE] Fed. Rep. of Germany ... 8417094[U]

[51] Int. Cl.[4] ..... F28D 17/02; F28D 19/04

[52] U.S. Cl. ..... 165/10; 165/905; 165/4

[58] Field of Search ..... 165/10, 40, 905

[56] References Cited

U.S. PATENT DOCUMENTS 2,974,404 3/1961 Humenik, Jr. et al. ..... 165/10

3,678,992 7/1972 Daniels ..... 165/10

FOREIGN PATENT DOCUMENTS 2997 9/1983 World Int. Prop. O. ..... 165/10

*Primary Examiner*—Albert W. Davis, Jr.

*Attorney, Agent, or Firm*—Herbert L. Lerner; Laurence A. Greenberg

[57] ABSTRACT

A corrosion-resistant storage body for a regenerator includes a multiplicity of carbon shapes having profiles formed thereon, the shapes being stacked together with the profiles spacing the shapes apart defining canals between the shapes passing through the storage body, and a frame holding the stacked shapes together.

1 Claim, 2 Drawing Figures

STORAGE BODY FOR A REGENERATOR

Figure 1:
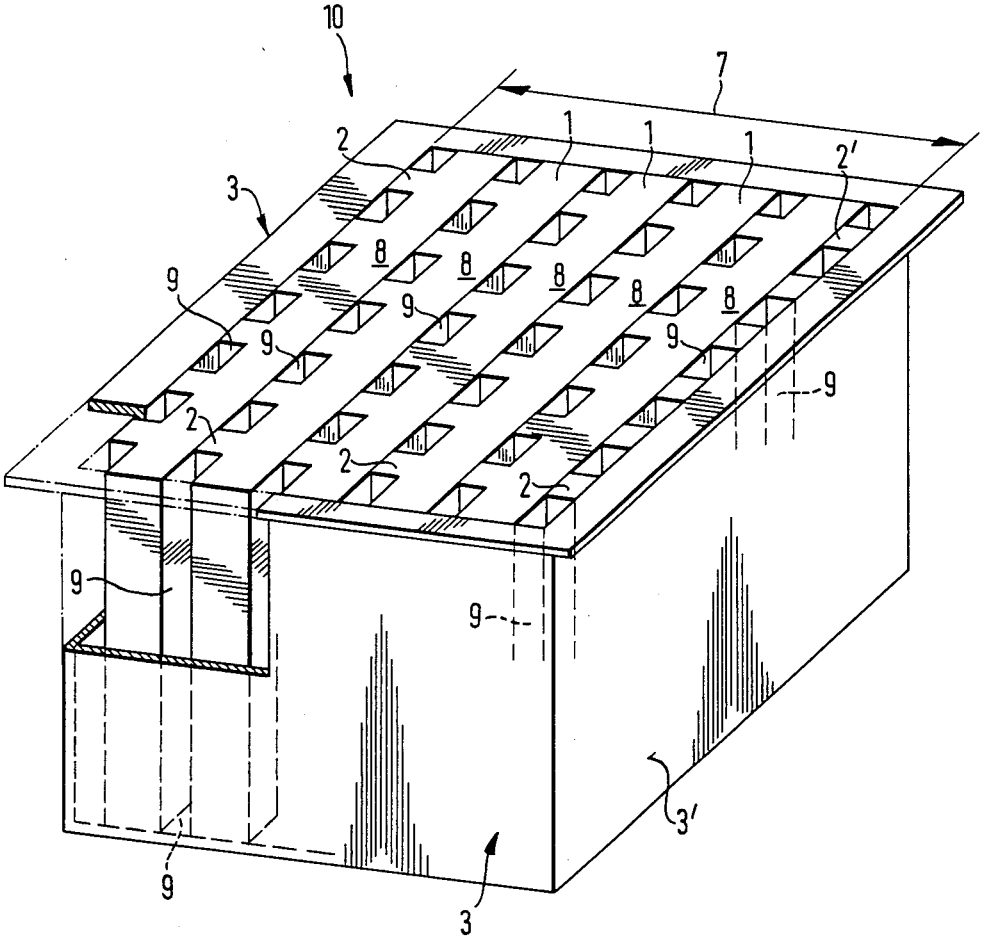

The invention relates to a storage body for a regenerator, especially for recovering thermal energy from hot corrosion gases. Storage bodies used in regenerators for preheating air as a rule are formed of several metal sheets or sheet metal strips having spacings therebetween and having a total of several hundred square meters of heat-exchanging area per cubic meter. A disadvantage of metallic storage bodies is the limited corrosion and temperature resistance. Therefore, sheet metal formed of an alloy steel, enameled sheet metal or bodies formed of a ceramic are used if heat must be transferred to or from hot corrosive gases. Storage bodies containing plastic sheets or foils are only suitable for relatively low temperatures because of the low temperature resistance thereof. Sheet metal formed of an alloy steel is generally only resistant to certain materials, so that the use of regenerators with such storage bodies is limited to certain operating conditions. Enameled sheet metal can be used more flexibly. However, as a result of periodic temperature changes, cracks are formed in the enamel coating and the sheet metal corrodes. Storage bodies formed of ceramic are frequently not satisfactory because of the small heat transfer coefficient and the low temperatureshock resistance does not always meet the requirements of the storage body.

It is accordingly an object of the invention to provide a storage body for regenerators, which overcomes the hereinafore-mentioned disadvantages of the heretofore-known devices of this general type, and which is also operable at high temperatures.

With the foregoing and other objects in view there is provided, in accordance with the invention, a corrosion-resistant storage body for a regenerator, especially for recovering thermal energy from hot corrosion gases, comprising a multiplicity of carbon shapes having profiles formed thereon, the shapes being stacked together with the profiles spacing the shapes apart defining canals between the shapes passing through the storage body, and a frame holding the stacked shapes together.

In accordance with another feature of the invention, the storage body consists of extruded shapes.

In accordance with a concomitant feature of the invention, the shapes are carbon tubes and the profiles are spacers disposed between the tubes.

Other features which are considered as characteristic for the invention are set forth in the appended claims.

Although the invention is illustrated and described herein as embodied in a storage body for a regenerator, it is nevertheless not intended to be limited to the details shown, since various modifications and structural changes may be made therein without departing from the spirit of the invention and within the scope and range of equivalents of the claims.

Figure 2:
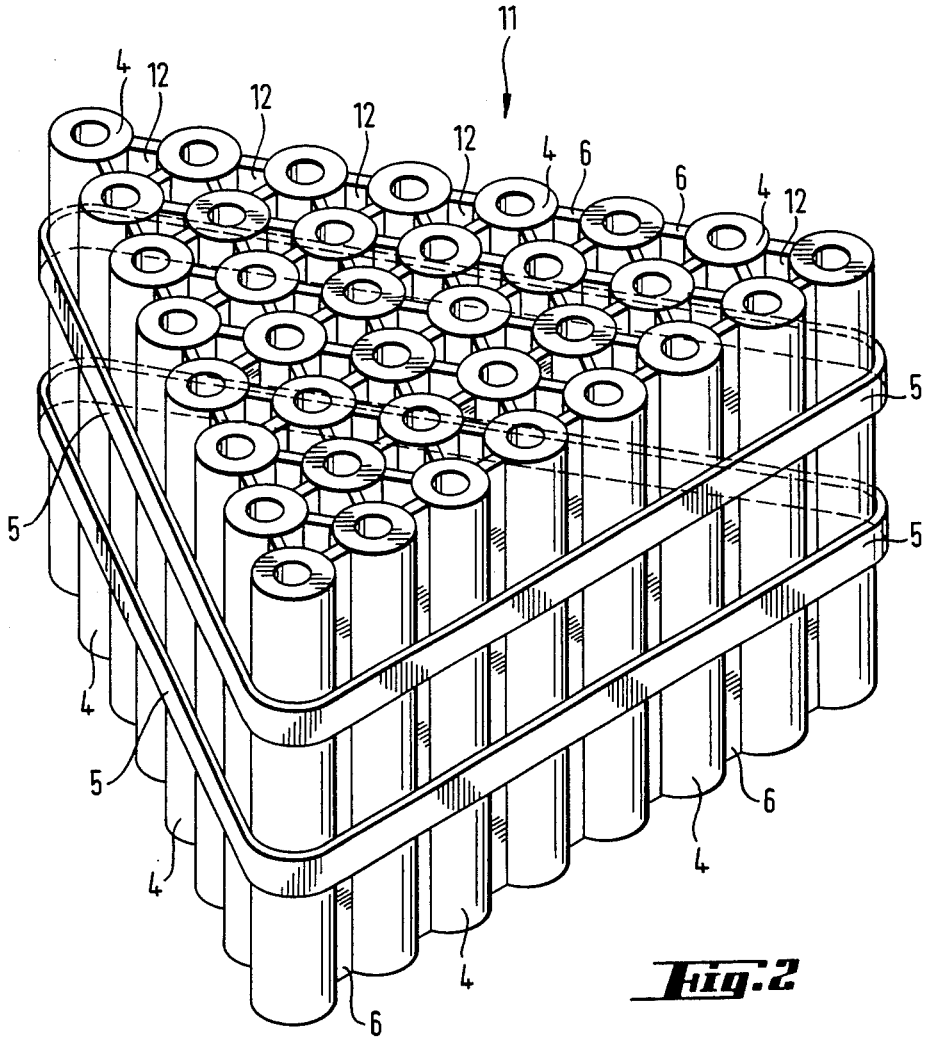

The construction and method of operation of the invention, however, together with additional objects and advantages thereof will be best understood from the following description of specifif embodiments when read in connection with the accompanying drawings, in which:

FIG. 1 is a diagrammatic perspective view, partly in section, of a storage body with plate-like carbon shapes; and FIG. 2 is a perspective view of a storage body formed of carbon tubes.

Referring now to the figures of the drawings in detail and first, particularly to FIG. 1 thereof, there is seen a storage body 10 made up of carbon plates formed of shapes 8 which have ridge-like profiles 2 forming together the profiled carbon shapes 8. The shapes 8 form a stack 7 in such a manner that canals 9 which pass through the storage body 10 are formed between the shapes 8. The shapes 8 are set in a box-like frame 3 and ridges 2' are disposed between a frame wall 3' and the first plate 1 of the stack 7. This construction produces canals which pass through the storage body 10 and through which heat-exchanging gases flow.

The storage body 11 shown in FIG. 2 is formed of carbon tubes 4 which are bundled and set in a framework 5. For increasing the exposed cross-sectional areas 12 of the storage body 11, spacers 6 which are disposed between the tubes 4, are inserted into slot-like guides formed in the tubes 4 or are cemented to the tubes. The spacers are formed of carbon, like the tubes.

The carbon shapes are produced by molding mixtures containing coke powder, graphite powder, carbon black, anthracite and the like along with carbonizable binders. The mixtures are subjected to a heat treatment for pyrolizing the binder and are optionally graphitized in special furnaces, so that even bodies which consist substantially of graphite, are understood to be included under the term "carbon shapes".

According to the invention, the shapes are profiled, i.e., at least one surface of every shape is inclined against the adjacent surface of the frame which encloses the shape or shapes, and/or against the surface of the adjacent shapes.

The width of the gap through which the heat-exchanging media flow is determined by the shape of the profile: Examples of the profiles are the ribs or ridges of FIG. 1, the height and width of which is adapted to the prevailing operating conditions. Advantageously, the profiles are formed into the carbon body so that special machining of the shapes is not necessary. The body is formed in a manner known in the art by die or isostatic pressing, by vibration forming, or by extrusion in extrusion presses. Extruded carbon blanks which have a large dimension in the longitudinal direction and a small thickness, form particularly advantageous elongated storage bodies. The carbon tubes of FIG. 2 which can be bundled to form storage bodies of almost any shape and dimension, are also particularly advantageous. The pressings forming the storage body are set in a frame which facilitates the assembly and disassembly of the storage bodies in the regenerator. The storage body is suited for heat exchange carried out at high temperatures and in contact with corrosive fluids such as flue gases, without intermediate cooling.

The foregoing is a description corresponding in substance to German Application No. G 84 17 094.8, filed June 5, 1984, the International priority of which is being claimed for the instant application, and which is hereby made part of this application. Any material discrepancies between the foregoing specification and the aforementioned corresponding German application are to be resolved in favor of the latter.

What is claimed is:

1. Corrosion-resistant storage body for a regenerator, comprising a multiplicity of extruded carbon tubes and spacers, said tubes being stacked together and said spacers being disposed between said tubes defining channels passing through the storage body, and a frame holding said stacked tubes and spacers together.

* * * * *